United States Patent [19]

Osika

[11] 4,230,917

[45] Oct. 28, 1980

[54] REMOVABLE-KEY ROCKER TYPE SWITCH FOR TWO CIRCUITS

[75] Inventor: Thomas F. Osika, Valparaiso, Ind.

[73] Assignee: McGill Manufacturing Company, Inc., Valparaiso, Ind.

[21] Appl. No.: 11,206

[22] Filed: Feb. 12, 1979

[51] Int. Cl.[3] ..... H01H 27/06

[52] U.S. Cl. ..... 200/42 T; 200/339

[58] Field of Search ..... 200/42 R, 427, 321, 200/322, 339; 70/336

[56] References Cited

U.S. PATENT DOCUMENTS

| | | | |
|---|---|---|---|
| 3,225,153 | 12/1965 | Carling | 200/67 G X |
| 3,604,865 | 9/1971 | Batcheller et al. | 200/339 X |
| 3,632,914 | 1/1972 | Osika | 200/42 T |
| 3,678,229 | 7/1972 | Osika | 200/427 |
| 3,906,176 | 9/1975 | Carlson | 200/42 T |
| 3,914,563 | 10/1975 | Prior | 200/427 |
| 4,013,858 | 3/1977 | Grebner et al. | 200/427 X |

FOREIGN PATENT DOCUMENTS

| | | | |
|---|---|---|---|
| 1076787 | 3/1960 | Fed. Rep. of Germany | 200/427 |

*Primary Examiner*—Stephen Marcus
*Attorney, Agent, or Firm*—Foorman L. Mueller

[57] ABSTRACT

An electrical rocker switch of the type having a removable actuator key to prevent turning the switch "on" when the key is removed, such switch having a rockable carrier member for operating switching bridge structure, a rocker member mounted cooperatively with said carrier member in a switch casing and with each such two members being movable independently of the other about a common axis. The removable key couples the rocker member and carrier member so that all three are then operated together as a coupled structure by actuation of such key, said switch having contact means for two different circuits, with the key member when inserted into the carrier-rocker members in one direction accomplishing the operation of the contact means to close one of said two circuits through the switch, and with removal of the key member, rotation thereof through 180° about an axis at right angles to said common axis and then reinsertion in the carrier-rocker members in that rotated position coupling said two members for actuation by the key member when it is moved in the opposite direction to close the other circuit. The key member has a portion engageable with stop means with the switch to limit the key member movement in the direction of such movement until it is stopped, having closed the selected one of said two different circuits in an "on" position in such moving. The switch cannot be operated to a different circuit "on" position with the key removed.

11 Claims, 9 Drawing Figures

SWITCH "OFF"

FIG. 1
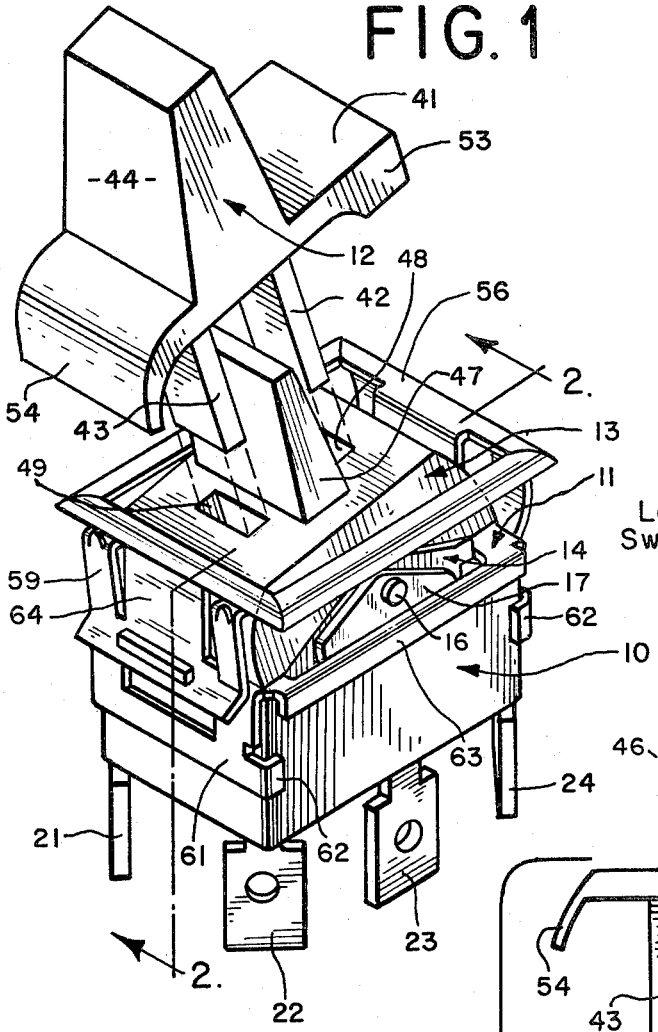
FIG. 3
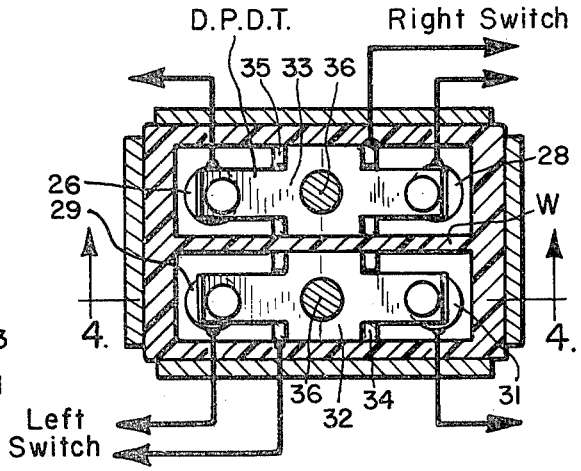
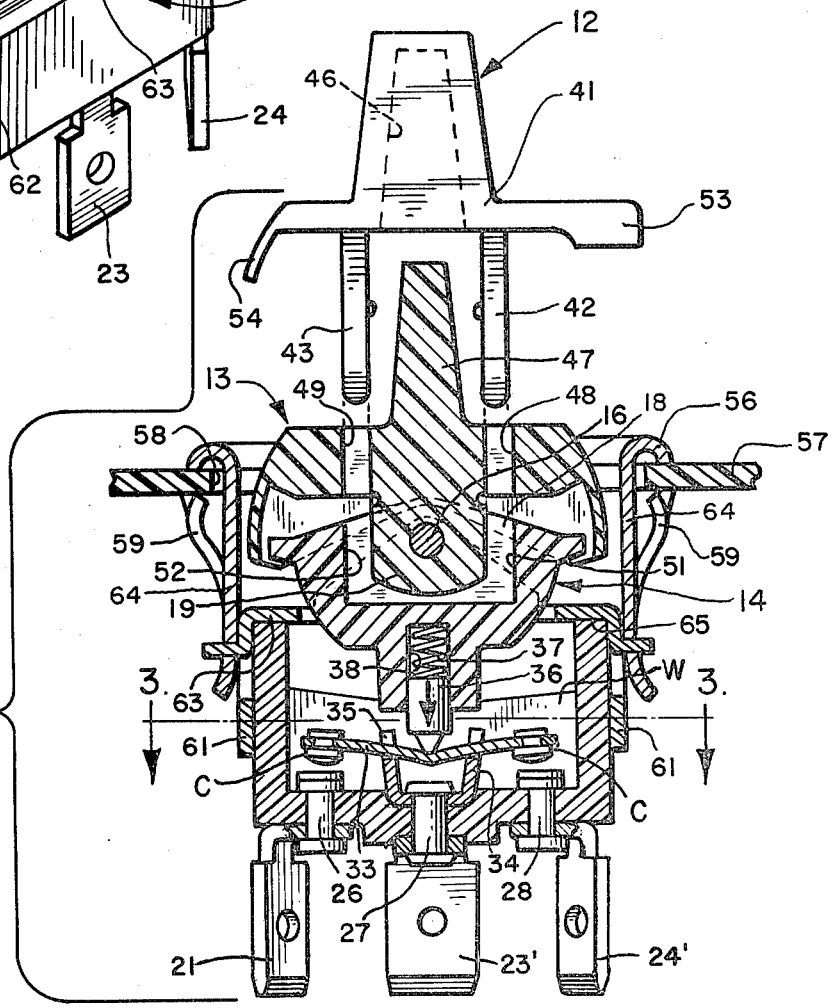
FIG. 2
SWITCH
"OFF"

FIG. 4
KEY IN PLACE
RIGHT SWITCH CLOSED
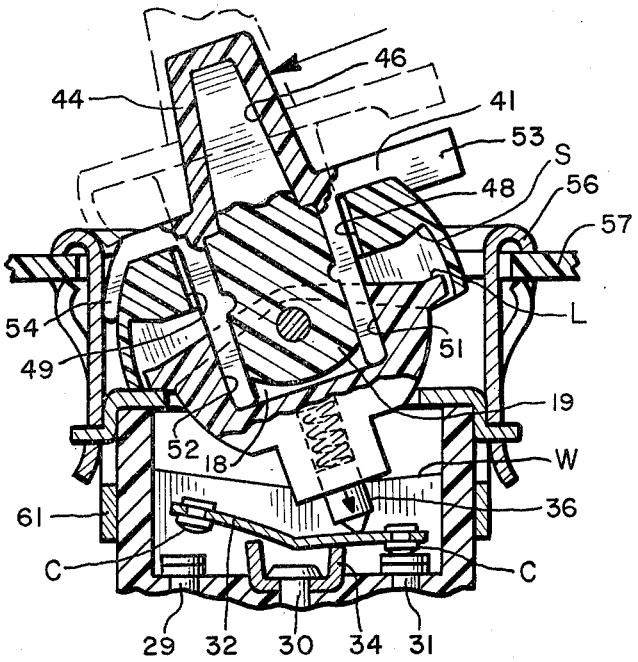
FIG. 5
KEY REMOVED, ROCKER RETURNING TOGGLE TO "OFF" POSITION"
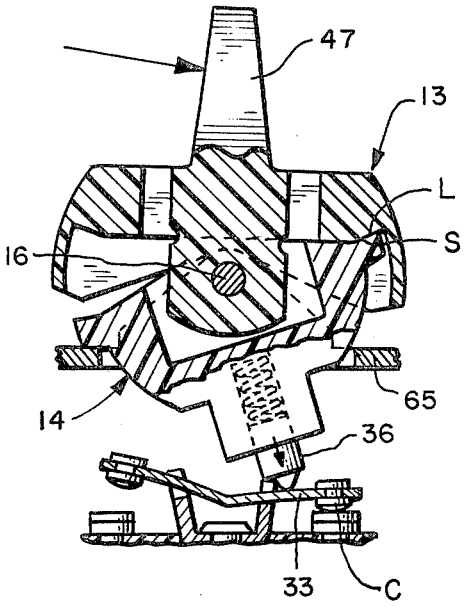
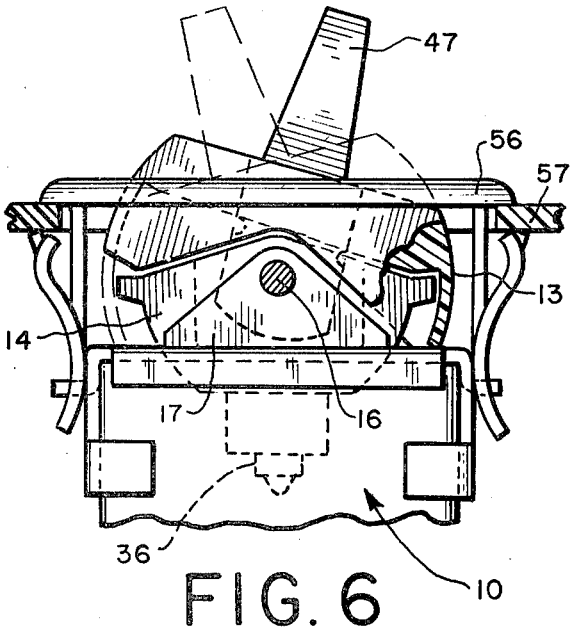
FIG. 6
"OFF" POSITION.
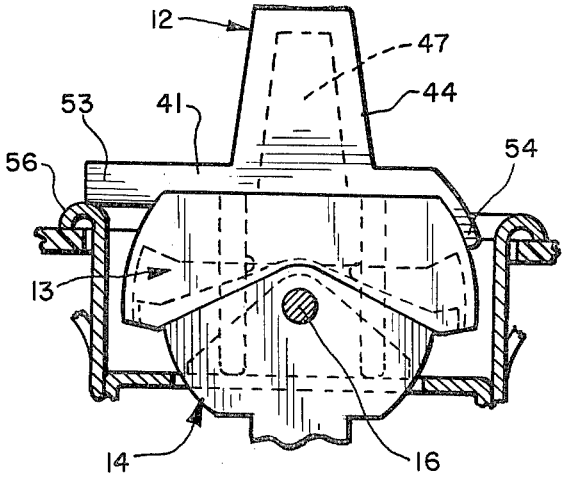
FIG. 7
KEY ROTATED 180° TO ACTUATE LEFT SWITCH

REMOVABLE-KEY ROCKER TYPE SWITCH FOR TWO CIRCUITS

BACKGROUND OF THE INVENTION

Removable key operated electrical switches are well known in the art, but generally are limited to the "on" and the "off" position of a single circuit with the "on" position at one end of the operating movement, and "off" at the other. Switches of this character are illustrated and described in U.S. Pat. No. 3,632,914 which issued Jan. 4, 1972 and 3,678,229 which issued July 18, 1972, both patents being assigned to the assignee of the present invention and this application.

Such switches perform very satisfactorily in a single circuit system, and particularly electrical systems for single power tools or other such equipments where the removed key prevents any inadvertent closing of such single circuit, but combinations of equipments such as two power tools, each with its own motor, are now being provided in industry and the cost, installation, and wiring as well as the operation of two such safety switches represents problems. The safety feature of a removable key is as important or more important to the operation of the two motor system as for the one motor to insure that only the selected motor is operated at one time and that the other motor cannot then be operated.

Other electrical circuits than those for motors are provided in dual arrangements wherein the safety of a removable key to prevent operation is equally important. In fact, the different arrangements are sufficiently varied that it is more accurate to describe the applications for the present invention as two-purpose electrical systems.

The present switch provides a single removable key for the operator to be concerned with in the selective operation of one or the other of such two-purpose electrical circuits. That key couples the removable rocker and movable carrier of the switch which in turn operate switching mechanism for two different electrical circuits one at a time. This single key is of such a configuration that it can be inserted in the rocker-carrier structure of the switch in one of two selected positions corresponding to the circuit it is desired to operate. The configuration of the single key also permits rotation thereof to a second position and reinsertion in the rocker-carrier structure in a second selected position to operate the switch and control the second circuit, thus providing the necessary safety of a removable key with greater usefulness in that a single device can operate both circuits one at a time.

SUMMARY OF THE INVENTION

This invention is a rocker type switch with a removable key as a safety feature to prevent the closing of a circuit through the switch when the key is removed, and such switches have served a useful function in the past and still do today in power tools and like industrial equipments using a single motor.

However, combinations of power tools with independent motors for each have come into use, and there are combinations of two systems with different purposes, such that an object of this invention is to provide a switch of the above type which will selectively operate the two different electrical circuits for said respective two purposes through the switch, one at a time, in an "on-off-on" pattern wherein one circuit is "on" at the stop position for the switch in one direction of movement, the "off" position for both circuits is in the middle of the full span of movement, and the second circuit "on" position is at the stop position in the opposite direction of movement for the switch.

Another object of the invention is to provide an improved removable-key rocker type switch for a two-circuit operation wherein the stopped position of the key in the switch determines the one of the two circuits that is closed, with the key in that position making it possible to selectively choose and then indicate by the switch key position the circuit being closed or completed for operation.

A feature of the present invention is the provision of a single removable key for a rocker type two-circuit switch, with the key insertable in the switch to couple a rocker and carrier in the operating structure so that such structure can be moved from either one of two key positions, with the key being removable, reversible 180° about a single axis, and insertable to couple the parts for operation of the key in the opposite direction. This provides a two-circuit operation in an "on-off-on" pattern with one switch, that has the safety feature of a removable key so that the rocker-carrier structure cannot be operated and neither circuit can be closed unless the key is inserted in a proper direction in the switch.

The present invention can also be described as providing a two-circuit rocker type switch wherein the operating member is a removable key of such configuration that when in position in the switch the user can recognize the direction in which the key must be moved for a switching operation. The key can readily be removed from one position and then reinserted into the switch in a different position so as to selectively operate either one of two circuits. The present invention with such key adds to the safety of operation of a two-purpose electrical circuit system for if the key is inserted into the switch in the wrong position for operating the selected circuit, the configuration of the key is such that it is stopped and the rocker-carrier structure which the key couples will not move far enough to close what would be the wrong circuit. The key must be removed, rotated 180°, and reinserted in the proper position for operation of the electrical circuit system originally intended. A rocker and a carrier each have openings therein which will receive the key in either one of its two positions and the key structure is symmetrical for ready insertion in either position.

Another feature of the present invention is that terminals, circuit bridges, and the like can be physically and electrically accommodated with the switch to operate circuit systems so that all of the advantages of this invention can be utilized in either a single pole or multipole switch.

Other objects and advantages of the invention will appear from the detailed description and the drawings as follows:

DESCRIPTION OF THE DRAWINGS

FIG. 1 is a perspective view of the complete switch mechanism, with the removable key separated slightly from the rocker member and the remainder of the switch to illustrate the key configuration with symmetrical legs to fit into symmetrical openings in the rocker and the carrier members.

FIG. 2 is a cross-sectional view along the line 2—2 of FIG. 1 looking in the direction of the arrows. The switch mechanism is shown in a center or "off" position for both circuits.

FIG. 3 is a sectional plan view at the line 3—3 of FIG. 2 looking in the direction of the arrows.

FIG. 4 is a vertical cross-sectional view generally of the switch and with the key in full inserted position shown partially in section, and with it also shown in dotted lines in a removed position. The switch in this figure shows the elements in an "on" position for the right-hand circuit which is bracketed on the right side in FIG. 3, and in that position the left switch as bracketed in FIG. 3 would be in "off" position.

FIG. 5 shows the uncoupled carrier and bridging members in the "on" position of FIG. 4, with the key removed, and with the rocker in an upright position. As will be explained, the rocker may be moved in the direction of the arrows to return the bridging member to "off" position as shown in FIG. 6 even though the key has been removed.

FIG. 6 shows uncoupled rocker and carrier members with the carrier member in "off" position and hitting the switch casing at the right at the end of its travel, and with the bridging member plunger in a dotted line "off" position.

FIG. 7 is a view showing the key, the rocker, and the carrier members all in a coupled position, and with the key in a position rotated 180° relative to its position in FIG. 2 for actuating the key and closing the left switch as shown in FIG. 3.

DETAILED DESCRIPTION

Figure 8:
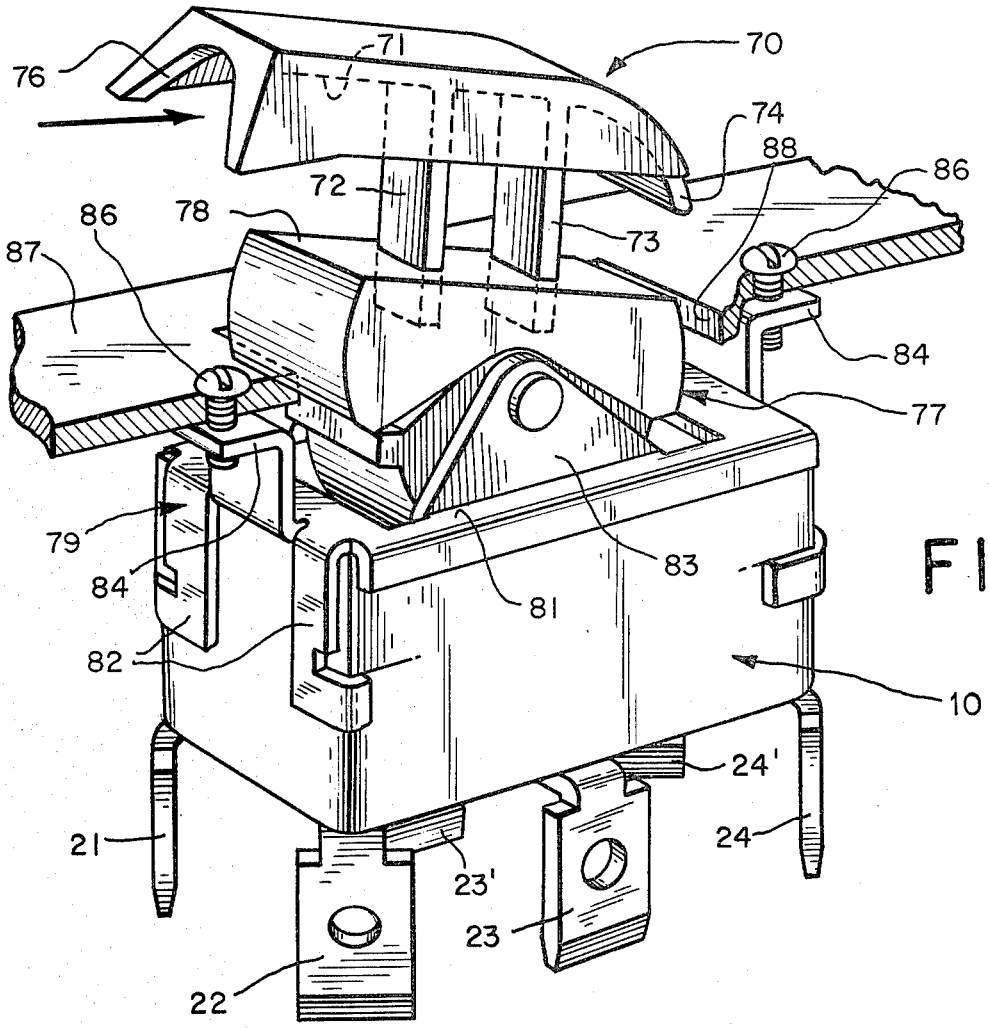
FIG. 8 is a side view of a modification of the removable key and the rocker in the switch with a modified support for the switch casing secured to a mounting plate which in turn can be secured to a flat surface for the equipment to be operated.

Referring to FIG. 1, the complete switch comprises a switch casing 10, mounting means 11 for the casing at an opening, and switch elements or members including the key 12, rocker 13, and carrier 14 (FIG. 2). These latter three operating members of the switch as housed and mounted in the casing 10 and by the mounting means 11 are pivoted as a structure on a common axis 16 supported by a pair of trunions 17 (only one of the two identical trunions is shown in FIG. 1) integral with the mounting means 11. This is accomplished by providing a cavity 18 in the carrier member 14 to receive the body portion 19 of the rocker member. These members are molded parts and suitable structure is provided to accomplish the interconnection of the rocker and carrier at the common axis 16. However, as is evident in FIGS. 2, 5 and 6, the rocker and carrier members when not coupled together by the key 12 can be rotated at the common axis 16 independently of one another.

The sectional plan view in FIG. 3 along the line 3—3 in FIG. 2 shows the internal switching elements, FIG. 2 shows the switching elements in an "off" position for both circuits, while FIG. 4 shows what will be called for convenience the "right switch" in closed circuit position. Bridging members, and contacts which are shown in FIG. 3 make up a "left switch" on the left side of that figure, and the "right switch" on the right side.

Four of the six outside terminals for the illustrated embodiment of the invention are shown in FIG. 1 and referenced as 21, 22, 23 and 24. FIG. 2, which is a vertical cross-section along line 2—2 of FIG. 1 shows the other two terminals referenced 23' and 24'. Each outside terminal is secured to the casing 10 by an eyelet, with eyelets 26, 27 and 28 shown in FIG. 2 for terminals 21, 23' and 24' respectively, and eyelets 29, 30 and 31 are shown in FIG. 4 for terminals 22, 23 and 24 respectively. As shown in FIG. 3, bridging members 32 and 33 are respectively supported for a rocking movement on metal supports 34 and 35 insulated from one another in individual molded cavities in the bottom of the switch casing separated by an integral wall W. Each bridging member has a contact portion C at each end for selective engagement with a corresponding stationary contact at the top of each of the eyelets, a contact C on bridging member 32 engaging either eyelet 29 or 31 depending upon the circuit to be closed, and the contact C on bridging member 33 engaging either eyelet 26 or 28. Each bridging member is "off" when in the position of bridging member 33 in FIG. 2, and in such position the rocker-carrier-key structure is upright.

The rocking movement of the carrier 14 is transposed through plungers 36 (FIG. 2) with each spring biased downwardly by a spring 37, with each housed in a bore 38 in the lower portion of the carrier. There are two bridging members 32 and 33 and two plunger 36 assemblies for operating such respective bridging members, but only a single carrier 14 and a single rocker 13 coupled by the single key 12 are utilized to operate the two plungers and bridging members. The circuit connections provided for the "left switch" and for the "right switch" (FIG. 3) are in parallel. That for the "right switch" and bridging member 33 being terminal 21—eyelet 26, contact C, and bridge support 35 (FIG. 2) as well as terminal 23'—eyelet 27. The bridging member 32 is in the "left switch" and the circuit is from terminal 22—eyelet 29, a contact C on the bridging member, bridge support 34, and terminal 23—eyelet 30. Correspondingly, the "right switch" includes a bridging member, a bridge support and a center terminal as previously described, with terminal 24'—eyelet 28, and a contact C, as well as terminal 23'—eyelet 27 with terminal 21—eyelet 26. These connections for the respective two switch elements can be more readily understood in referring again to FIG. 3.

So far as the circuitry through this switch is concerned, it is to be understood that the double pole double throw switch illustrated herein and as described is merely illustrative of one circuit application for this invention and that other circuit arrangements can be accommodated such as a single-pole double throw, a three-pole double throw, or a four-pole throw arrangement, etc. Many circuit arrangements can be built into this switch or with the switch for each of two controlled circuits or each of two electrical circuit systems. The switch is adapted for use with just two different circuits, such as two separate motors, and each of such two circuits or electrical systems can be made into a single, double, triple, or four-pole construction with the corresponding required external jumpers and combinations of bridges internally of the switch. There is a wide latitude in this respect for each one of the two different circuits in their respective desired combinations. Correspondingly, single phase or multiple phase, and non-reversing as well as reversible motors can be operated with different arrangements of terminals, contacts, bridge, and jumpers in the switch. The switch structure of this invention for each different circuit arrangement, however, includes a rocker and a carrier, and a removable key insertable for coupling the same in two different positions in such rocker and carrier each position in 180° rotation from one another about a single axis. The direction of movement of the inserted key to a stop position indicates the one of the two circuits selected by the operator to be closed for operating a motor or other equipment connected into that circuit. The switch cannot be operated to close the other circuit until the key is removed, rotated 180°, and reinserted to couple the rocker and carrier for movement in the opposite direction. The key construction and receptacles or openings in the rocker and the carrier which serve as keyways are all symmetrical so that the key can be readily accommodated in either of said two positions.

Continuing with the description of the key 12 as shown in the FIGS. 1, 2 and 4, in particular, this comprises a one-piece molded member with a skirt portion 41, a pair of legs 42 and 43 projecting in one direction from the skirt portion and a handle portion 44 (FIG. 1) projecting in the opposite direction to be grasped by a user to remove or insert the same, and to move the complete structure for switching when that structure is coupled by the key. The handle portion 44 includes a cavity 46 opening upwardly from underneath the skirt 41 to fit over the rocker projection or knob 47. Apertures 48 and 49 in the rocker 13 line up with cavity portions 51 and 52 in the carrier 14 when the key couples the rocker and carrier as shown in FIG. 2, 4 and 7. When the key 12 operates the carrier 14 and rocker 13 as a single structure about the axis 16, the legs 42 and 43 are releasably retained in the cooperating aperture 48 and cavity portion 51, and the aperture portion 49 and cavity portion 52 as shown in full lines and in cross-section in FIG. 4. The skirt 41 of the key 12 includes a straight projecting portion or extension 53 which serves as a stop at one end, and there is a semicurved lip 54 at the other end. The legs 42 and 43 are symmetrical as are the apertures 48 and 49 in the rocker 13, and as are the cavity portions 51 and 52 in the carrier 14. They receive the two legs 42 and 43 to couple the rocker and carrier together.

With the cavity 46 in the handle portion of the key symmetrical, as is the knob 47 on the rocker (FIG. 2), the key 12 can be inserted either in that position to which it is directed in FIG. 2, or rotated 180° about an axis at right angles to the axis 16 and inserted as can be understood from FIG. 7. In other words, in FIG. 2 the extension 53 extends in one direction and that same extension 53 extends in the opposite direction when the key has been rotated and is properly inserted and positioned as in FIG. 7. FIG. 4 shows the "right switch" closed, and with the key 12 in the position of FIG. 7, the "left switch" can be closed. Of course, the plunger 36 is in "off" position for both switches with a corresponding effect on each bridging member in FIGS. 2 and 6. The key 12 would operate in a clockwise direction in the position of FIG. 7 to close the "left switch," and cannot be rotated in a counterclockwise direction because of the stop 53 engaging a bezel 56 which insures against the closing of the other switch to another motor in a multiple power tool combination, for instance. The key 12 would operate in a counter-clockwise direction in its position in FIG. 4, and operate the "right switch".

In summary; the illustration of FIG. 4 is partly in section and partly in full lines and shows the position for the "right switch" operation with the lip 54 within the bezel 56 so that full counterclockwise movement of the key is accomplished, while in FIG. 7, with the key in a 180° rotated position, the lip 54 will extend within the bezel 56 to permit full clockwise movement. However, with the key removed as in FIG. 5, the rocker 13 and carrier 14 are not coupled so that this structure could not move the plunger 36 to a position for closing the "left switch" through the bridging members, but there is a shoulder S, within the rocker 13 engaging a ledge L on the carrier 14 and movement of the rocker clockwise will pivot the carrier and plungers 36 therewith to an "off" position.

Considering now the mounting means or structure 11 in a commercial embodiment of the present invention, a one-piece stamping is provided as shown particularly in FIG. 1 and comprises the bezel 56 which engages the top of a mounting plate 57 (FIG. 2) while the entire mounting means is locked to such plate at an aperture 58 therein by spring fingers 59 at both ends which spring under the plate 57 when the device is inserted through such aperture 58. A flange 61 on each end with locking ears 62 (FIG. 1) maintains the switch casing 10 firmly therebetween, and a rim 63 fits on the top edge 65 of the casing 10. Trunions 17, previously described on each side extend upwardly from the rim 63 to the bezel 56, and a wall 64 at each end likewise each connect integrally to such bezel. This mounting structure 11 has been very satisfactory for one embodiment of the present invention, but it is understood that the switch may be otherwise mounted in a suitable aperture or mounting plate.

FIGS. 5 and 6 illustrate the operation to "off" position that can be accomplished by the rocker member 13 and the carrier member 14 when the key 12 is removed from its coupling connection. FIG. 5 shows a bridging member 33 in an "on" position with the "right switch" as indicated in FIG. 3. If it is desired to turn that circuit "off" the rocker 13 can be rotated clockwise at the projection 47, and because the rocker 13 and carrier 14 are each confined at the common axis 16 the rocker 13 engages and presses on the carrier 14 until the rocker is stopped at the rim 65 of the switch casing. The dimensions are such that in the latter position the plunger 36 moves on the bridging member 33 in a toggle action and ends up in the center in the "off" position as in FIG. 2 (and FIG. 6) where it will stay until the key 12 is inserted and couples the rocker and carrier members to move the same in whatever direction is indicated by the inserted position of the key as in FIG. 4, and in FIG. 7 for movement to an "on" position. The user can readily determine in which position he wishes to insert the key, for the extension or stop 53 will immediately indicate to such user either a clockwise or counterclockwise direction for switching on a circuit, and the movement in such direction will be opposite to that of the direction of the extension or stop 53.

Figure 9:
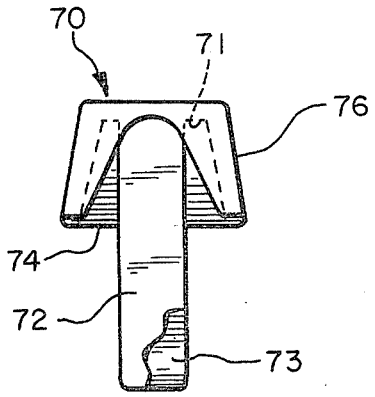
FIG. 9 is an end view of the removable key looking from the left in the direction of the arrow in FIG. 8.

A further configuration for a key and for the rocker structure is illustrated in FIGS. 8 and 9, along with a different mounting means for the switch casing 10. This key and rocker can be used with the remaining structure for the switch as illustrated in FIG. 1, and the modification of the mounting means in FIG. 8 can also be used with the switch structure itself of FIG. 1.

The key 70 comprises a molded hollow body 71 with symmetrical legs 72 and 73 extending downwardly therefrom of a length to couple a rocker and carrier exactly in the manner of the embodiment of FIG. 1. A wall around the hollow body 71 includes a semicurved lip 74 performing the same function as the lip 54, while an extension 76 at the opposite end permits the user's finger or thumb to be inserted to lift the key 70 for a rocking movement in a clockwise direction in the manner of the FIG. 1 embodiment. The rocker 77 corresponds to the rocker 13 except that it has a flat surface 78 across the top and the key 70 and rocker 77 are dimensioned to be coupled and function as do the key 12 and rocker 13 except that the key is lifted as explained above for operating movement as with the handled key 12. The remainder of the switch and the circuit connections are made as previously described.

The mounting means for the switch comprises a single metal stamping 79 with a rim 81 that fits on the top edge of the casing 10, and fingers 82 extending downwardly therefrom at each of the four corners to clamp against the corner of the casing at an indented portion which holds the mounting means securely thereon. Integral trunions 83 support the axis for the carrier and rocker, and integral L-shaped extensions 84 have threaded apertures for screws 86 or the like extending through a mounting plate 87 for securing the switch thereto at an aperture 88. It is understood that this mounting means can be secured at an aperture to a part of the tool or equipment in the same manner as here illustrated and described.

The present invention provides a sturdy and compact rocker type switch with a removable key that will control two different electrical circuits or electrical circuit systems with protection so that only one circuit can be operated with the key in each of two alternative positions thus serving the functions of two such type of rocker switch, one for each circuit or system as has been done in the past. This provides a lower switch cost, lower installation costs, and only a single key to be concerned with when it is removed from the switch as a safety feature.

I claim:

1. In a removable key operated electrical switch of the rocker type having switch housing means with a rocker member and a carrier member and a keyway in each for receiving a key, each such member being pivotally mounted therein on an axis common to both and each being pivotal independently of the other, and contact bridging means operatively connected with said carrier member for movement upon pivotal movement of said carrier member, the improvement with said housing means of stationary contact means for said contact bridging means for selectively making two different electrical circuits therethrough upon operation of said switch, and a key insertable in said switch having means for coupling together said rocker member and said carrier member at said keyways for rockably moving said members about said common axis in one of two opposite directions to complete a selected one of said two different circuits, said key being removable from said coupling of said members in said switch, being rotatable through 180° about a single axis, and said key being of such configuration that it can be reinserted in said switch after such rotation in a second position for again coupling said rocker member and said carrier member at said keyways for movement thereof in the other of the two opposite directions, with said key movements in said recited switching being such that only one circuit can be completed in each of said two inserted positions of said key.

2. In the switch of claim 1 wherein the removable key comprises means for handling the same by the switch use for operating the key and hence the switch, with a stop portion at one end of said key and a curved portion oppositely disposed at the other end of said key, a pair of symmetrical legs extending downwardly relative to said two portions and intermediate thereof, with said legs being insertable in said keyway formed in said rocker and said carrier members in either of said two rotated positions for said key.

3. In the switch of claim 1 wherein the removable key comprises a body having means for handling the same by the switch user, means on said key for stopping the movement of the key at a predetermined position in one direction of said movement and means permitting limited rockable movement in the opposite direction, insertable means on said key extending in a direction generally at right angles to a line through said stopping means and said limiting means.

4. In the switch of claim 1 wherein the removable key comprises a handle portion, a pair of spaced apart symmetrical leg means extending in a direction opposite to the handle portion, a skirt between said leg means and said handle portion extending outwardly in a direction generally at right angles to said leg means, with one side of said skirt having an extension stoppable in a predetermined position in either of said two inserted positions of said key to limit the switching movement of said key.

5. In the switch of claim 1 adapted to operate according to an "on-off-on" circuit pattern wherein said carrier member and said rocker member each have apertures therein forming together a keyway to accept said projecting means of said key for said coupling, said rocker member having a projection extending upwardly therefrom and said key member having a handle portion thereon with a cavity extending upwardly therein to receive said upwardly extending projection on the rocker member, said projecting means comprising two spaced apart legs for insertion into said apertures, and with said legs, said apertures, said upward extending projection, and said handle cavity all being symmetrical in a manner such that said key may be inserted in either of said two recited positions.

6. In the switch of claim 1, said switch mounting and housing means including a snap-in mounting member and a switch casing, said switch casing accommodating therein said carrier member, said rocker member, said contact bridging means and said stationary contact means, said snap-in mounting member having a bezel therewith adapted to be engaged by said key upon switching movement of the latter to limit said movement thereof, and having an integral trunion on each of two sides thereof to provide a pivotal support between said two trunions for the common axis for said carrier and said rocker members.

7. In a removable key operated electrical switch of the rocker type having switch housing means with a carrier member and a rocker member pivotally mounted on a common axis in such housing means and movable bridging member means in said housing adapted to be moved to selected positions upon the switching movement of said carrier and said rocker members, the improvement comprising stationary contact means for accommodating two different electrical circuit systems each to be selectively completed to and through said switch and to be engageable by said bridging member means in an "on-off-on" circuit pattern, and a key member having projecting means therewith insertable in one position into said rocker member and said carrier member to couple the same together for a rockable switching movement as a single combination structure, said single combination structure upon said switching movement adapted to move said bridging member means and close or open only one electrical circuit system through stationary contact means, with said key member being thereafter removable from said one position insertion, being rotated, and being insertable in a second position to again couple said rocker member and carrier member together as a single combination structure for switching movement by said key member to move said bridging member means and close or open only the other of said two electrical circuits to and through stationary contact means, with said two inserted positions of said key being representative of a 180° rotation thereof and the operation of only one circuit in each position.

8. In a removable key operated electrical switch of the rocker type having switch housing means with a carrier member and a rocker member each pivotally mounted therein on a common axis and adapted to be coupled together for rocking movement as an operating structure, said carrier member having spring biased plunger means maintained therewith, bridging member means movably supported in said housing means and operatively engageable for a circuit bridging function by said plunger means, the improvement comprising stationary contact means providing for connections to accommodate two different circuits to be made one at a time to and through said switch, and a removable key member adapted to be inserted into said operating structure to couple together and rockably move said structure and said bridging member means therewith, with said key member being insertable into said structure in one position of said key member for operating said switch to close or open only one of the two electrical circuits, and said key member being removable, rotatable 180° about a single axis and insertable into said structure in a second position corresponding to said rotated position for operating said switch to close or open only the other of the two electrical circuits which can be accommodated in said switch.

9. In a removable key operated electrical switch of the rocker type having switch housing means with a carrier member and a rocker member each pivotally mounted therein on a common axis and each having apertures enabling said two members to be coupled together for rocking movement as an operating structure, bridging member means movably supported in said housing means and operatively connectable with said carrier member for a circuit bridging function, the improvement comprising stationary contact means providing for two different electrical circuit system connections to be made to and through said switch, and a removable key having means thereon for fitting in said apertures to couple and rockably move together said carrier member and said rocker member and move said bridging member means therewith, said key coupling said carrier member and said rocker member in each of two different positions in said apertures for selected operation of one or the other of said two different electrical circuit systems, with movement of said key in one of said two different coupling positions acting to close or open only one of said two circuit systems, and with movement of said key in the other of said selected coupling positions acting to close or open only the other of said two circuit systems as one of said two movements in an "on-off-on" circuit pattern.

10. In a dual function electrical switch utilizing a single key for selectively operating only one of two circuits at a time through said switch, said switch having contact structure and contact closing structure to receive said key, and with the position of said key determining the circuit being operated, the improvement comprising a key removable from said contact closing structure to prevent the operation of said switch when it is removed having a configuration for selective insertion in said contact closing structure in either one of two positions which are 180° apart about a single axis, said key moving said contact closing structure in one direction to close one corresponding single circuit only in that one inserted position thereof and said key moving said contact closing structure in the opposite direction to close the other corresponding single circuit only in that second inserted position thereof.

11. In an electrical switch as defined in claim 10 wherein said contact closing structure includes recess means therein, and said key has a handle portion thereon to be grasped by an operator of said switch, and a pair of legs extending away from said handle portion, said key being selectively rotatable about said axis to one of said two positions for insertion into said recess means to operate said switch and close only the circuit corresponding to the inserted position of said key.

* * * * *